US009197007B2

(12) United States Patent
Shinmi

(10) Patent No.: US 9,197,007 B2
(45) Date of Patent: Nov. 24, 2015

(54) HOUSING FOR CONNECTOR AND SECURING SAME TO WIRING HARNESS

(71) Applicant: YAZAKI CORPORATION, Minato-ku, Tokyo (JP)

(72) Inventor: Yoshifumi Shinmi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 106 days.

(21) Appl. No.: 13/928,553

(22) Filed: Jun. 27, 2013

(65) Prior Publication Data

US 2014/0011394 A1 Jan. 9, 2014

(30) Foreign Application Priority Data

Jul. 4, 2012 (JP) ..... 2012-150271

(51) Int. Cl.

| | |
|---|---|
| ***H01R 31/08*** | (2006.01) |
| ***H01R 13/58*** | (2006.01) |
| ***H01R 9/03*** | (2006.01) |
| *H01R 4/70* | (2006.01) |

(52) U.S. Cl.

CPC ..... *H01R 13/5804* (2013.01); *H01R 9/03* (2013.01); *H01R 4/70* (2013.01)

(58) Field of Classification Search

CPC ..... H01R 25/006; H01R 29/00; H01R 31/08
USPC ..... 439/189, 507, 510, 511, 516
See application file for complete search history.

(56) References Cited

U.S. PATENT DOCUMENTS

| | | | | |
|---|---|---|---|---|
| 5,525,077 | A * | 6/1996 | Badaroux | 439/595 |
| 5,725,398 | A * | 3/1998 | Cappe | 439/752 |
| 6,276,964 | B1 * | 8/2001 | Shinozaki | 439/595 |
| 7,351,085 | B2 * | 4/2008 | Tamagawa et al. | 439/189 |
| 7,476,113 | B2 * | 1/2009 | Tamagawa et al. | 439/189 |
| 7,648,388 | B2 * | 1/2010 | Kanazawa et al. | 439/516 |
| 7,780,459 | B2 * | 8/2010 | Yamamoto et al. | 439/76.2 |
| 7,806,720 | B2 * | 10/2010 | Omori et al. | 439/507 |
| 7,862,374 | B2 * | 1/2011 | Ichio et al. | 439/595 |
| 7,883,362 | B2 * | 2/2011 | Ichio et al. | 439/511 |
| 8,083,543 | B2 * | 12/2011 | Omori et al. | 439/511 |
| 9,054,474 | B2 * | 6/2015 | Omori et al. | 174/69 |

FOREIGN PATENT DOCUMENTS

| | | | |
|---|---|---|---|
| DE | 112009000065 | T5 | 2/2011 |
| JP | 2000-331751 | A | 11/2000 |

OTHER PUBLICATIONS

German office action letter issued on Jun. 12, 2015 in the counterpart German patent application.

* cited by examiner

*Primary Examiner* — Thanh Tam Le
(74) *Attorney, Agent, or Firm* — Marvin A. Motsenbocker; Mots Law, PLLC

(57) ABSTRACT

A connector housing is provided that has a guiding portion which guides a tape when the connector becomes engaged with a wire harness. The wire harness and the connector housing are bound to each other via the tape. Embodiments are provided wherein a concave portion of the guiding portion has a shape with a corner portion rounded in an arc or a shape in which the corner portion is chamfered.

9 Claims, 6 Drawing Sheets

Prior Art

Prior Art

HOUSING FOR CONNECTOR AND SECURING SAME TO WIRING HARNESS

BACKGROUND OF THE INVENTION

1. Field of the Invention

The present invention relates to a housing for connector, and particularly relates to the housing for connector which is installed for use on a wire harness by employing a tape.

2. Related Background of the Invention

Conventionally, as shown in FIG. 6, a joint terminal 307 has been proposed, which is configured to include a main body portion 301 formed in a rectangular cylindrical shape, a plate-shaped male contact portion 303 that projects in a lateral direction from one side wall portion along the lateral direction in the main body portion 301, and a female contact portion 305 provided inside the main body portion 301.

It should be noted that the joint terminal 307 is configured such that it moves with respect to a joint-terminal-accommodating housing 309, and thereby the joint terminal 307 is accommodated in an accommodation hole of the joint-terminal-accommodating housing 309, and taken out from the accommodation hole.

In the joint-terminal-accommodating housing 309, a plurality of the joint terminals 307 is installed (accommodated) at the same time. The respective joint terminals 307 installed in the joint-terminal-accommodating housing 309 are arrayed in the lateral direction by being spaced from each other in a predetermined interval. Then, into a female contact portion of one joint terminal 307, a male contact portion of another joint terminal 307 enters which is located adjacent to the above-described one joint terminal 307, and the joint terminals 307 located adjacent to each other are electrically conducted to each other.

As shown in FIG. 7, there is such a case that the joint-terminal-accommodating housing 309 which has accommodated therein the joint terminals 307 is installed on a wire harness 313 by employing a tape 311.

Also, there is conventionally known a configuration in which in order to prevent positional displacements of the joint-terminal-accommodating housing 309 installed on the wire harness 313 by employing the tape 311, as shown in FIG. 9, an antiskid member 315 is wound around an outer circumference of the wire harness 313, and the joint-terminal-accommodating housing 309 is installed on a portion where the antiskid member 315 is installed (for example, refer to Patent Document 1).

PRIOR ART DOCUMENT

Patent Document

[Patent Document 1] Japanese Patent Application Laid-Open Publication No. 2000-331751

SUMMARY OF THE INVENTION

On the other hand, in the configuration shown in FIG. 7 or FIG. 9, there is a problem that positional displacement might occur with respect to the wire harness 313, as shown in FIG. 8, when the joint-terminal-accommodating housing 309 is installed on the wire harness 313 and the tape 311 is wound thereon.

This problem cannot be avoided by the conventional configuration in which the antiskid member 315 is wound around the outer circumference of the wire harness 313. It should be noted that FIG. 8 shows the positional displacement of the tape 311, there is also a case in which as with the positional displacement of the tape 311 shown by a two-dot chain line, when the tape 311 is wound, such positional displacement may occur that the joint-terminal-accommodating housing 309 is inclined with respect to the wire harness 313.

Also, the above-described problem is a problem which may similarly occur in case that another joint-terminal-accommodating housing other than the joint-terminal-accommodating housing 309 shown in FIG. 6 is installed on the wire harness 313.

The present invention has been made in view of the above-described problem, and has an object to provide a housing for connector which is installed on a wire harness by employing a tape, and is capable of eliminating a positional displacement at the time of installation on the wire harness.

The housing for connector of the present invention is the one that is installed on a wire harness by employing a tape, wherein a guiding portion is formed, which guides the tape when the housing for connector is engaged with the wire harness and the housing for connector and the wire harness are bound with each other by the tape.

In the above-described housing for connector, it is preferable that the guiding portion is configured by a concave portion formed at least at a partial corner portion of the housing for connector, and the concave portion has a shape in which the corner portion is rounded in an arc or a shape in which the corner portion is chamfered.

In the above-described housing for connector, it is preferable that the housing for connector is formed in a rectangular parallelepiped, the housing for connector is configured to be installed on the wire harness such that a front-back direction of the housing for connector and a stretching direction of the wire harness coincide with each other, and a lower end face of the housing for connector is in contact with the wire harness, and the concave portion corresponds to each of two corner portions which are positioned at boundaries between an upper end face of the housing for connector and both end faces of the housing for connector in a lateral direction, the concave portions are formed at an intermediate portion of the housing for connector in the front-back direction.

DESCRIPTION OF THE PREFERRED EMBODIMENTS

A description will now be made of embodiments of the present invention based upon drawings.

A housing 1 for connector (housing) according to an embodiment of the present invention accommodates a plurality of connector terminals (joint terminals) therein and is then installed, similar to the conventional one, for example.

The connector terminals are installed on end portions of electric cables to be used, similar to the conventional ones. Then, respective connector terminals set on a plurality of electric cables (not shown) respectively are accommodated in the housing 1 where a plurality of accommodation holes 3 is provided (accommodated with each of the connector terminals inserted in each of the accommodation holes 3, respectively), and thus the electric cables will be connected (electrically conducted) to each other via the respective connector terminals.

For convenience of explanation, it is assumed that a longitudinal direction of the housing for connector 1 is defined as a front-back direction (extraction/insertion direction of connector terminal from/into housing 1); one direction orthogonal to the longitudinal direction is defined as a lateral direction; and a direction orthogonal to the front-back direction and the lateral direction is defined as a vertical direction.

In one housing 1, a plurality of connector terminals will be simultaneously installed by being arrayed along the lateral direction. Among the respective installed connector terminals, connector terminals adjacent to each other are electrically conducted in contact with each other.

Figure 1:
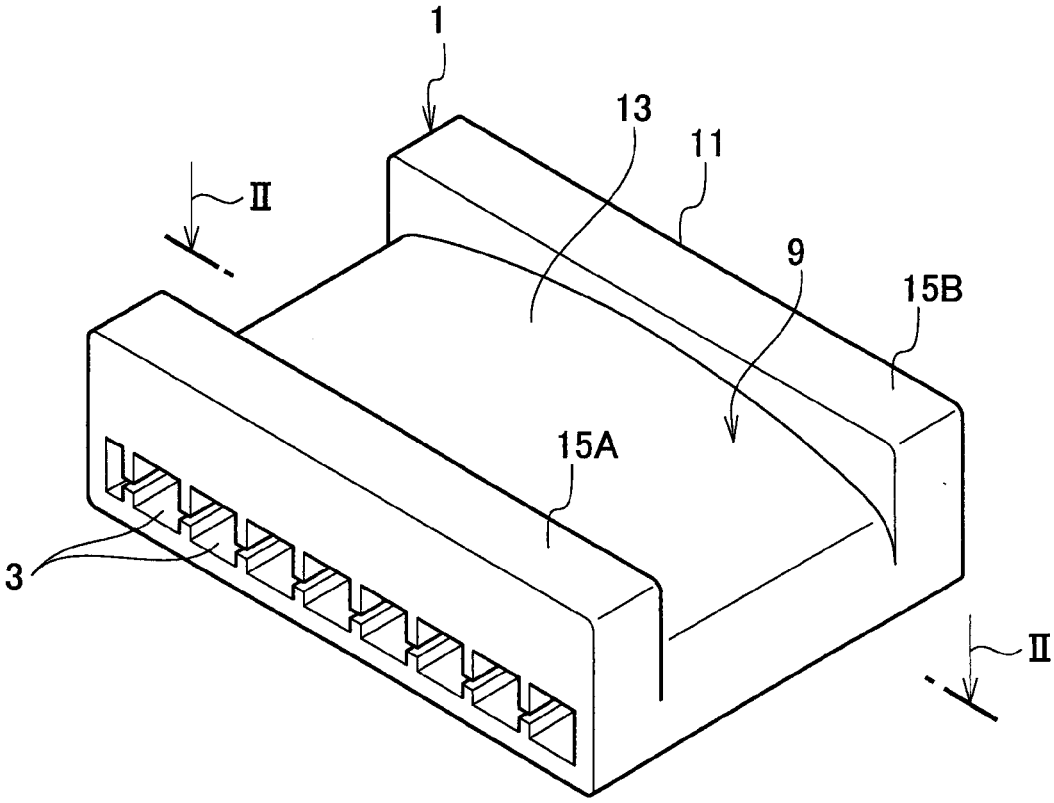
FIG. 1 is a perspective view showing a schematic configuration of a housing for connector according to an embodiment of the present invention.
Figure 2:
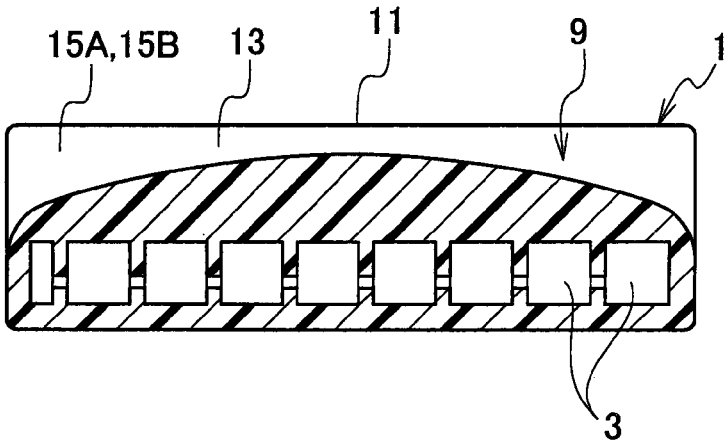
FIG. 2 is a view showing a II-II section in FIG. 1.
Figure 3:
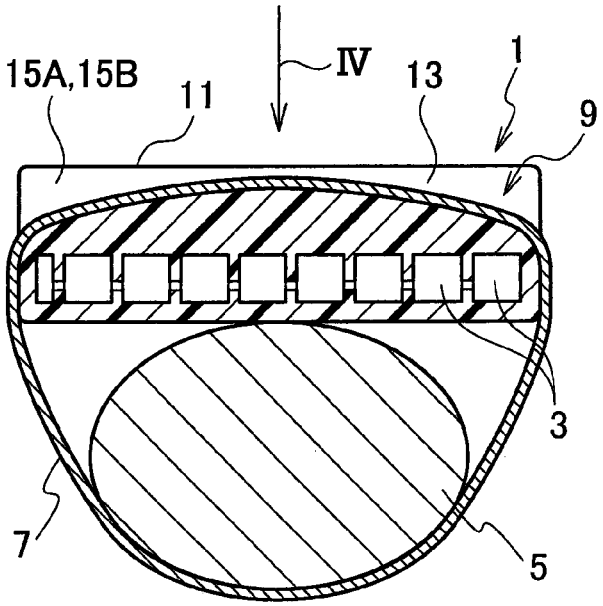
FIG. 3 is a view showing a state in which the housing for connector according to the embodiment of the present invention is installed on a wire harness by employing a tape (sectional view by a plane orthogonal to a longitudinal direction of the wire harness).
Figure 4:
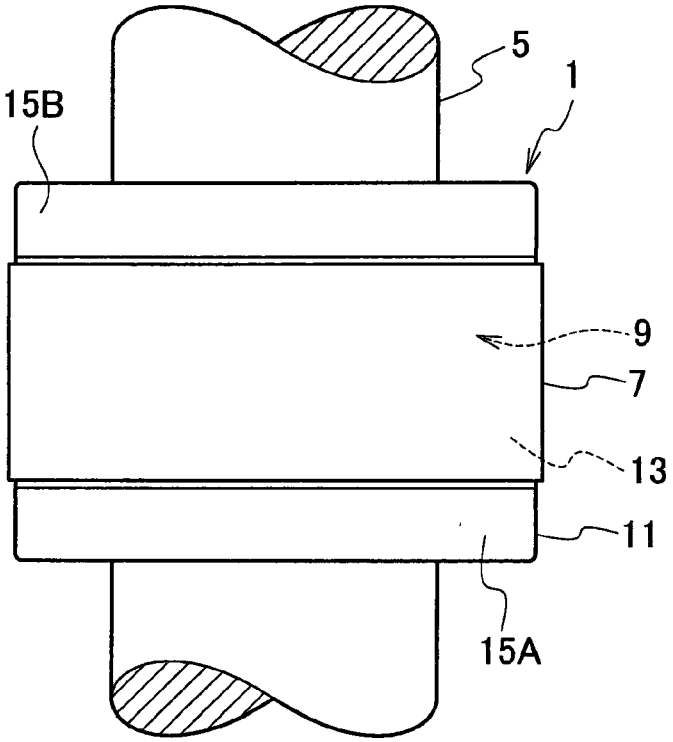
FIG. 4 is a view as viewed along an arrow line IV in FIG. 3.

As shown in FIG. 3 and FIG. 4, the housing 1 for connector (connector terminal accommodating housing) is installed (fixed) on a wire harness 5 by employing a tape 7.

A guiding portion 9 is provided in a main body portion 11 of the housing for connector 1. The guiding portion 9 is a portion that guides the tape 7 when the housing for connector 1 is engaged (for example, is in contact) with the wire harness 5, and the housing for connector 1 and the wire harness 5 are bound with each other by the tape 7.

The housing for connector 1 and the wire harness 5 are bound with each other by the tape 7, and thus the band-shaped tape 7 stretches along the longitudinal direction thereof outside the wire harness 5 and the housing for connector 1; the tape 7 is wound by at least one turn (tape 7 becomes ring shape); and both the wire harness 5 and the housing for connector 1 are fastened to be tied up.

Although the guiding portion 9 is configured by a concave portion 13 formed in the main body portion 11 of the housing for connector, the guiding portion 9 may be configured by a convex portion (not shown) formed in the main body portion 11 of the housing for connector.

Also, while the wire harness 5 and the housing for connector 1 are bound with each other by the tape 7 and when binding thereof is accomplished, a positional displacement is prevented in the tape 7 by the guiding portion 9.

The tape 7 is configured by, for example, a vinyl tape (tape in which either adhesion or adhesiveness is provided on one plane of a band-shaped base material constituted by a synthetic resin along a thickness direction thereof). Then, the plane where the adhesive or the like is provided is positioned on the side of an inner plane of the ring-shaped tape 7.

It should be noted that a string-shaped member (binding band such as, for example, INSULOK (registered trademark)) where the adhesive or the like is not provided may be employed as the tape 7.

The guiding portion 9 is configured by the concave portion 13 which is formed at least at a partial corner portion (either a partial corner portion of respective corner portions or all of the corner portions, and furthermore, either a partial portion of a corner portion or all portions of the corner portion) of the main body portion 11 of the housing for connector (housing for connector 1). The concave portion 13 has a shape in which the corner portion is rounded in an arc or a shape in which the corner portion is chamfered with a plane (refer to FIG. 2, FIG. 5A, FIG. 5B, FIG. 5C, and FIG. 5D).

The main body portion 11 of the housing for connector is formed in a rectangular parallelepiped (rectangular flat plate shape) which is defined by a predetermined dimension in the front-back direction (longitudinal direction), by a predetermined dimension (dimension which is substantially equal to dimension in the front-back direction) in the lateral direction, and by a predetermined dimension (dimension which is smaller than dimension in the front-back direction, and dimension in the lateral direction) in the vertical direction.

The housing for connector 1 is configured such that the housing for connector 1 is installed on the wire harness 5 in such a manner that a portion (namely, a portion which extends in straight-line shape over entire length along the front-back direction at center portion in the lateral direction) of a lower plane of the main body portion 11 of the housing for connector is in contact with the wire harness 5, while the front-back direction of the main body portion 11 of the housing for connector and a stretching direction (longitudinal direction) of the wire harness 5 coincide with each other.

The concave portion 13 which configures the guiding portion 9 corresponds to each of two corner portions which are positioned at boundaries between an upper end face of the main body portion 11 of the housing for connector and both end faces of the main body portion 11 of the housing for connector along the lateral direction, and the concave portion 13 is formed at an intermediate portion of the main body portion 11 of the housing for connector along the front-back direction.

In other words, since the concave portion 13 is formed, a portion of the housing for connector 1 (main body portion 11) has a semi-cylindrical shape.

When a further explanation is made, the concave portion 13 is provided on the upper end face (opposite side of the wire harness 5) of the main body portion 11 of the housing for connector and at the intermediate portion of the main body portion 11 of the housing for connector along the front-back direction. Also, in the lateral direction of the main body portion 11 of the housing for connector, the concave portion 13 is provided over an entire width of the main body portion 11 of the housing for connector.

The concave portion 13 is formed in a symmetrical manner with respect to a plane which passes through a center of the housing for connector 1 and is orthogonal to the front-back direction. Also, the concave portion 13 is formed in a symmetrical manner with respect to a plane which passes through the center of the housing for connector 1 and is orthogonal to the lateral direction.

A section (section of bottom of the concave portion 13) defined by a plane which is orthogonal to the front-back direction of the housing for connector 1 has an arc shape. However, a radius of curvature of the arc is small on the both end sides along the lateral direction, and is large at the intermediate portion.

When a further explanation is made, the section of the housing for connector 1, which is defined by the plane orthogonal to the front-back direction of the housing for connector 1, has a shape in which a dimension thereof in the vertical direction becomes the largest at a center portion in the lateral direction, and becomes gradually small toward the end portions along the lateral direction. It should be noted that this decreasing ratio becomes large in the vicinity of the lateral direction.

Since the concave portion 13 is formed, such a mode is made that walls 15A and 15B protrude at the both end sides of the housing for connector 1 in the front-back direction.

In case that the housing for connector 1 is installed on the wire harness 5, connector terminals connected to electric cables are firstly set in the housing for connector 1.

Subsequently, the housing for connector 1 and the wire harness 5 are bound with each other by the tape 7 such that the housing for connector 1 is caused to be engaged with the wire harness 5, and the tape 7 is positioned within the concave portion 13 (tape 7 at the bottom of the concave portion 13 is in contact therewith).

Figure 8:
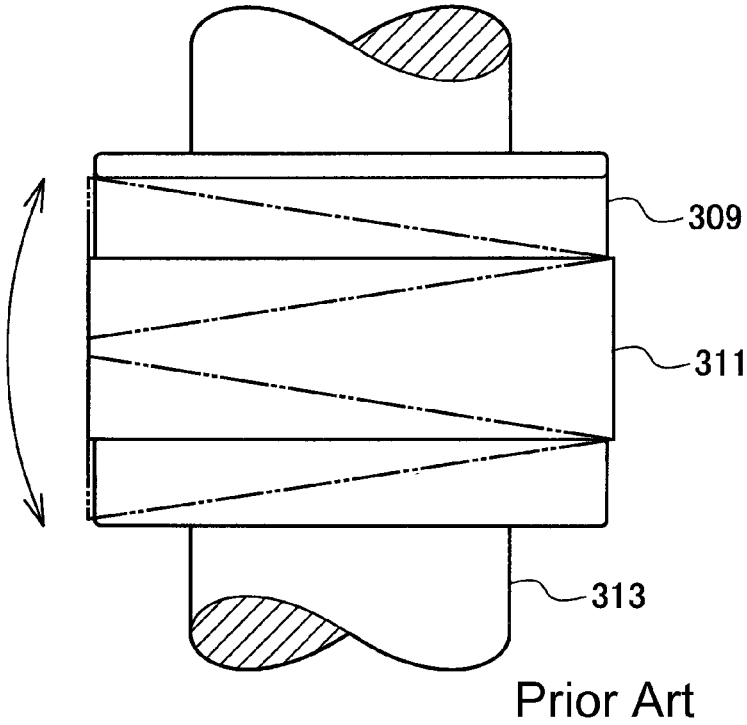
FIG. 8 is a view as viewed along the arrow line VIII in FIG. 7.
Figure 9:
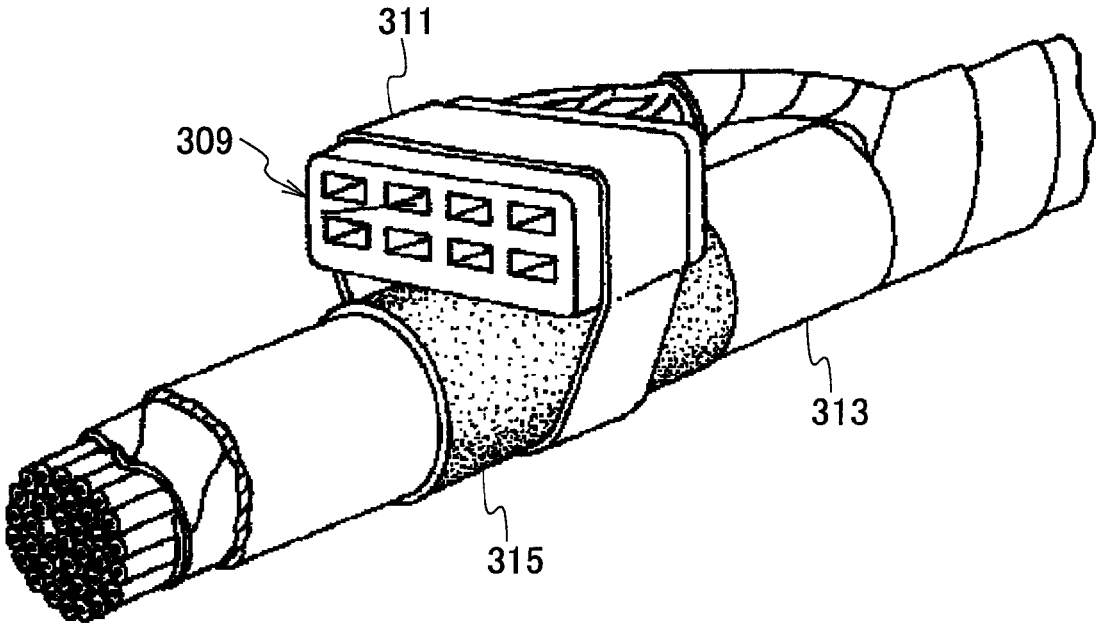
FIG. 9 is a perspective view showing the configuration in which the conventional housing for connector is installed on the wire harness by employing the tape.

According to the housing for connector 1, since the guiding portion 9 for guiding the tape 7 is formed in the main body portion 11 of the housing for connector, the tape 7 may be merely wound by employing the guiding portion 9 when the housing for connector 1 is installed on the wire harness 5, and it is possible to eliminate positional displacements (positional displacements shown in FIG. 8) of the tape 7 and the like at the time of installation on the wire harness 5.

Also, according to the housing for connector 1, since the guiding portion 9 is configured by the arc-shaped concave portion 13 which is formed at least at the partial corner portion of the main body portion 11 of the housing for connector, even after the tape 7 is once wound and the housing for connector 1 is installed on the wire harness 5, the tape 7 is tightly and closely contacted to the bottom of the arc-shaped concave portion 13, the positions of the tape 7 and the housing for connector 1 can be hardly displaced and further, there is no risk that winding of the tape 7 is unwound.

Also, according to the housing for connector 1, since the concave portion 13 is formed in each of the two corner portions, and further, the concave portions 13 are formed at the intermediate portion of the main body portion 11 of the housing for connector in the front-back direction, as understood from FIG. 3 and FIG. 4, the tape 7 can be wound at the correct position with the correct mode, and moreover, the housing for connector 1 can be continuously installed (fixed) on the wire harness 5 under more stable condition.

It should be noted that the form of the concave portions 13 may be alternatively changed in a proper manner.

Figure 5A:
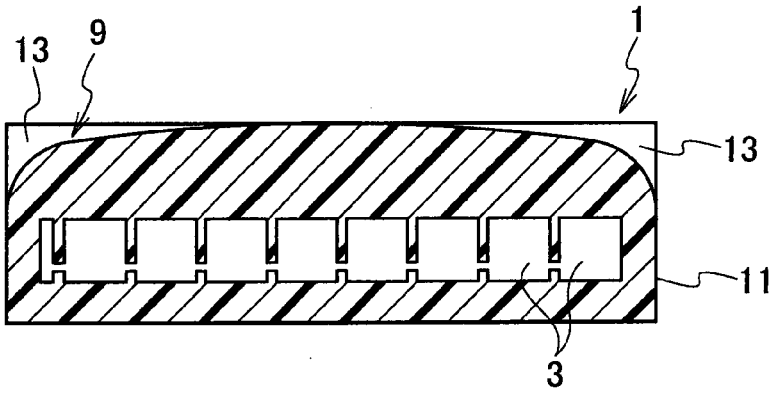
FIG. 5A is a view showing a schematic configuration of a housing for connector according to a modification, corresponding to FIG. 2, a view showing a mode in which arc-shaped concave portions are formed only on both end sides along a lateral direction.

For example, as shown in FIG. 5A, a mode may be employed in which the arc-shaped concave portions 13 are formed only on the both end sides along the lateral direction and not formed at the center portion and the intermediate portion.

Figure 5B:
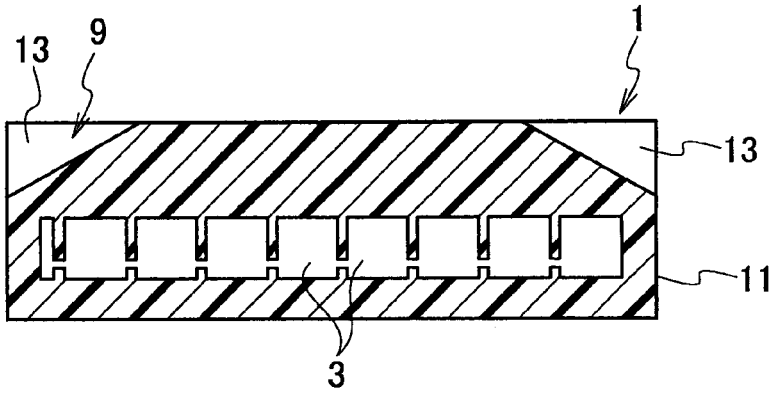
FIG. 5B is a view showing a schematic configuration of a housing for connector according to a modification, corresponding to FIG. 2, a view showing a mode in which concave portions are configured by a C plane formed on both ends along the lateral direction.

Also, as shown in FIG. 5B, the concave portions 13 may be configured by C planes formed at both ends along the lateral direction.

Figure 5C:
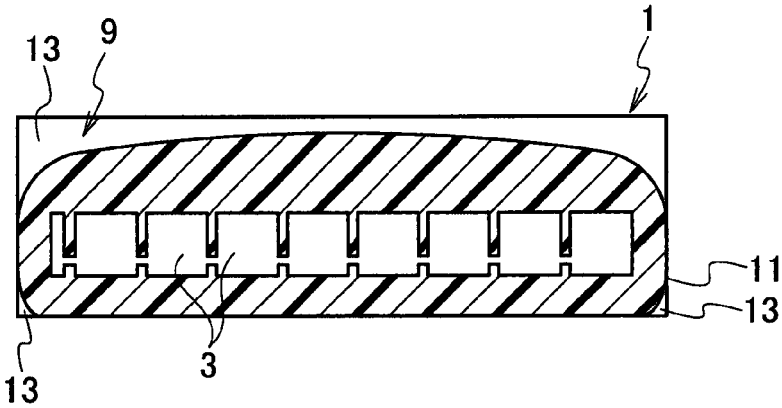
FIG. 5C is a view showing a schematic configuration of a housing for connector according to a modification, corresponding to FIG. 2, a view showing a mode in which arc-shaped concave portions are formed at corner portions of a lower end face.

Also, as shown in FIG. 5C, the arc-shaped concave portions (concave portion which is smaller than concave portion located opposite to concave portion provided on the side of wire harness 5; C plane-shaped concave portion may be employed) 13 may be formed also in the corner portion of the lower end face (on the side of wire harness 5).

Figure 5D:
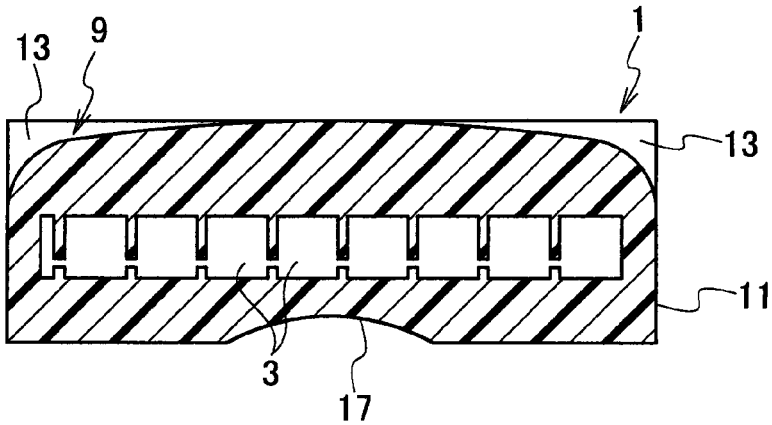
FIG. 5D is a view showing a schematic configuration of a housing for connector according to a modification, corresponding to FIG. 2, a view showing a mode in which an arc-shaped concave portion is provided at a portion of a lower end face with which a wire harness is in contact.
Figure 6:
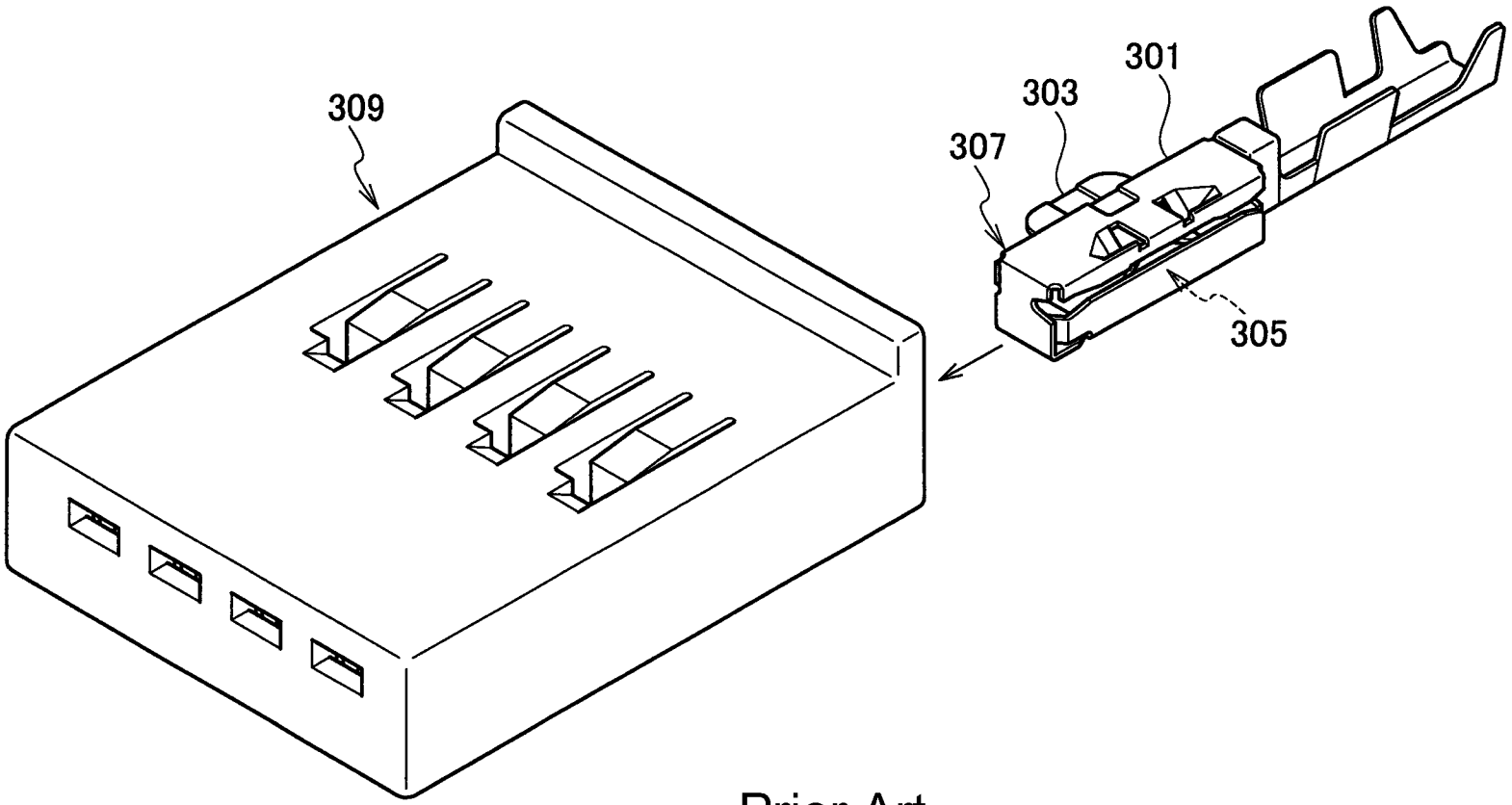
FIG. 6 is a perspective view showing the schematic configuration of the conventional joint terminal and housing in which the joint terminal is accommodated.
Figure 7:
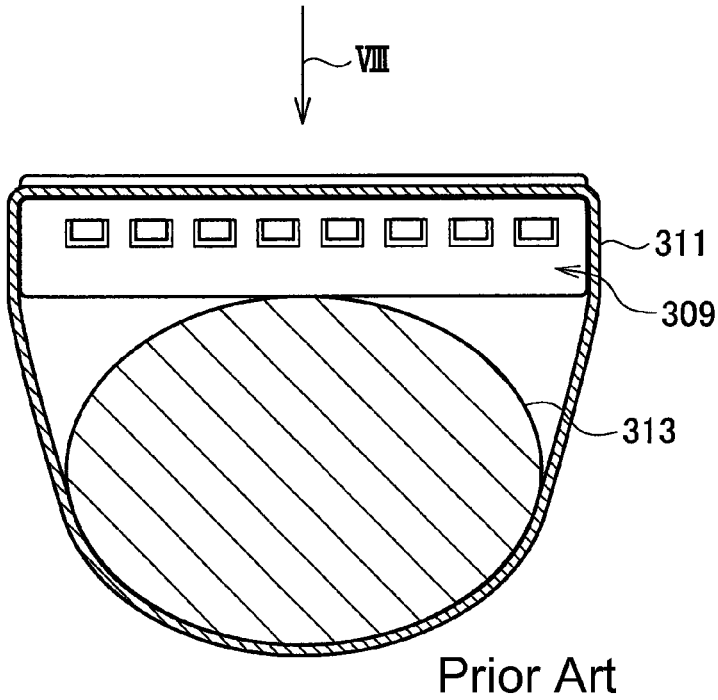
FIG. 7 is a view showing a state in which the conventional housing for connector is installed on the wire harness by employing the tape (sectional view by a plane orthogonal to a longitudinal direction of the wire harness).

Also, as shown in FIG. 5D, at a portion in contact with the wire harness 5, an arc-shaped concave portion 17 may be provided, in which a radius of curvature thereof is substantially equal to, or larger than that of the wire harness 5.

The present application claims priority based on Japanese Patent Application No. 2012-150271 filed on Jul. 4, 2012, the entire contents of which are incorporated herein by reference.

INDUSTRIAL APPLICABILITY

According to the present invention, there is an advantage that in the housing for connector which is installed on the wire harness by employing the tape, positional displacements at the time of installation on the wire harness can be eliminated.

DESCRIPTION OF REFERENCE NUMERALS OR SYMBOLS

1 Housing for connector
5 Wire harness
7 Tape
9 Guiding portion
13 Concave portion

What is claimed is:

1. A connector housing for being adhesive or non-adhesive binding-band bound onto a round wire harness, the connector housing defining a longitudinal orientation along which the wire harness extends, a lateral orientation orthogonal to the longitudinal orientation, and a vertical orientation orthogonal to both the longitudinal and the lateral orientations, and having an upper side in which a binding-band guiding portion is formed, and, reverse from the upper side, a lower side that contacts the wire harness when the housing is bound thereto, wherein the connector housing is characterized by:

the binding-band guiding portion being formed by walls on longitudinally opposing edges of the connector-housing upper side, the walls extending laterally and being orthogonal to the longitudinal orientation, for tightly and closely guiding the binding band when the lower side of the connector housing contacts the wire harness and the connector housing and the wire harness are bound with each other by the binding band; and the binding-band guiding portion is formed as a concave portion in an intermediate portion of the connector housing in the longitudinal direction.

2. The connector housing according to claim 1, wherein laterally opposing upper-side edges of the connector housing, between the longitudinally opposing walls, are either rounded in an arc, or are chamfered.

3. The connector housing according to claim 2, wherein the connector housing is in the form of a rectangular parallelepiped.

4. The connector housing according to claim 1, wherein the wire harness, being round, has a radius of curvature, and in the lower side of connector housing an arcuate concavity is provided having a radius of curvature substantially equal to, or larger than, that of the wire harness.

5. The connector housing according to claim 1, wherein the lower side of the connector housing contacts the wire harness such that the connector housing and the wire harness are bound with each other by the binding band, and wherein the binding band stretches along the longitudinal direction on an outside of the connector housing and the wire harness.

6. The connector housing according to claim 1, wherein the lower side of the connector housing contacts the wire harness and the connector housing and the wire harness are bound with each other by the binding band such that the binding-band guiding portion prevents a positional displacement of the binding band.

7. The connector housing according to claim 1, wherein the binding band comprises an adhesive vinyl tape.

8. The connector housing according to claim 1, wherein the binding band comprises an INSULOK® tape.

9. The connector housing according to claim 1, wherein the connector housing is installed on the wire harness such that an entire portion of the lower side of the connector housing in a center of the lateral direction and extending in the longitudinal direction contacts the wire harness.

* * * * *